US005237842A

United States Patent [19]

Rasch et al.

[11] Patent Number: 5,237,842

[45] Date of Patent: Aug. 24, 1993

[54] KEY AND COMBINATION LOCK FOR LUGGAGE

[75] Inventors: Ulf Rasch, Iserlohn; Franz Hauschulte, Menden, both of Fed. Rep. of Germany

[73] Assignee: Sudhaus Schloss- und Beschlagtechnik GmbH & Co., Iserlohn, Fed. Rep. of Germany

[21] Appl. No.: 805,523

[22] Filed: Dec. 10, 1991

[30] Foreign Application Priority Data

Dec. 5, 1991 [DE] Fed. Rep. of Germany ..... 4140137

[51] Int. Cl.[5] ..... E05B 37/00; E05B 65/52

[52] U.S. Cl. ..... 70/285; 70/69; 70/312

[58] Field of Search ..... 70/69–76, 70/284, 285, 312–315, 318

[56] References Cited

U.S. PATENT DOCUMENTS

| | | | |
|---|---|---|---|
| 2,168,621 | 8/1939 | Lane et al. | 70/285 |
| 3,408,839 | 11/1968 | Walters | 70/285 |
| 3,447,348 | 6/1969 | Davenbaugh | 70/285 |
| 3,633,388 | 1/1972 | Atkinson | 70/285 X |
| 3,677,042 | 7/1972 | Atkinson | 70/70 |
| 4,366,687 | 1/1983 | Atkinson | 70/312 X |
| 4,520,641 | 6/1985 | Bako | 70/312 |
| 4,557,122 | 12/1985 | Hwang | 70/312 |
| 4,671,088 | 6/1987 | Jeang | 70/284 X |
| 4,872,326 | 10/1989 | Aurness et al. | 70/312 X |
| 4,934,162 | 6/1990 | Rasch | 70/69 |

*Primary Examiner*—Peter M. Cuomo
*Assistant Examiner*—Suzanne L. Dino
*Attorney, Agent, or Firm*—Herbert Dubno

[57] ABSTRACT

A luggage latch for securing together two relatively movable parts has a latch housing on one of the parts, a latch component on the other of the parts engageable in the latch housing, and a keeper displaceable in the latch housing between a retaining position engaging and retaining the latch component and a freeing position out of engagement with the latch component and permitting same to be withdrawn from the housing. A combination lock on the housing has combination-lock elements operatively engageable with the keeper and movable between a locked position and an unlocked position respectively corresponding to the retaining and freeing positions of the keeper. In addition a key lock on the housing has a key-lock element operatively engageable with the keeper and movable between a locked position and an unlocked position respectively corresponding to the retaining and freeing position of the keeper. Either of the locks is capable of moving the keeper from the retaining to the freeing position regardless of the position of the other lock. The retaining position of the keeper is a central position and the keeper can move in opposite directions into two end freeing positions. The combination lock allows the keeper to move into one freeing position when it is unlocked and the key lock moves it into the other freeing position when it is unlocked.

7 Claims, 5 Drawing Sheets

FIG.7
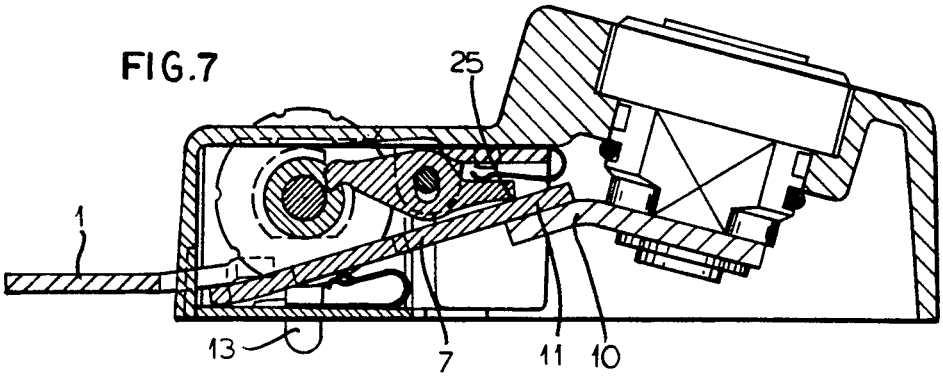
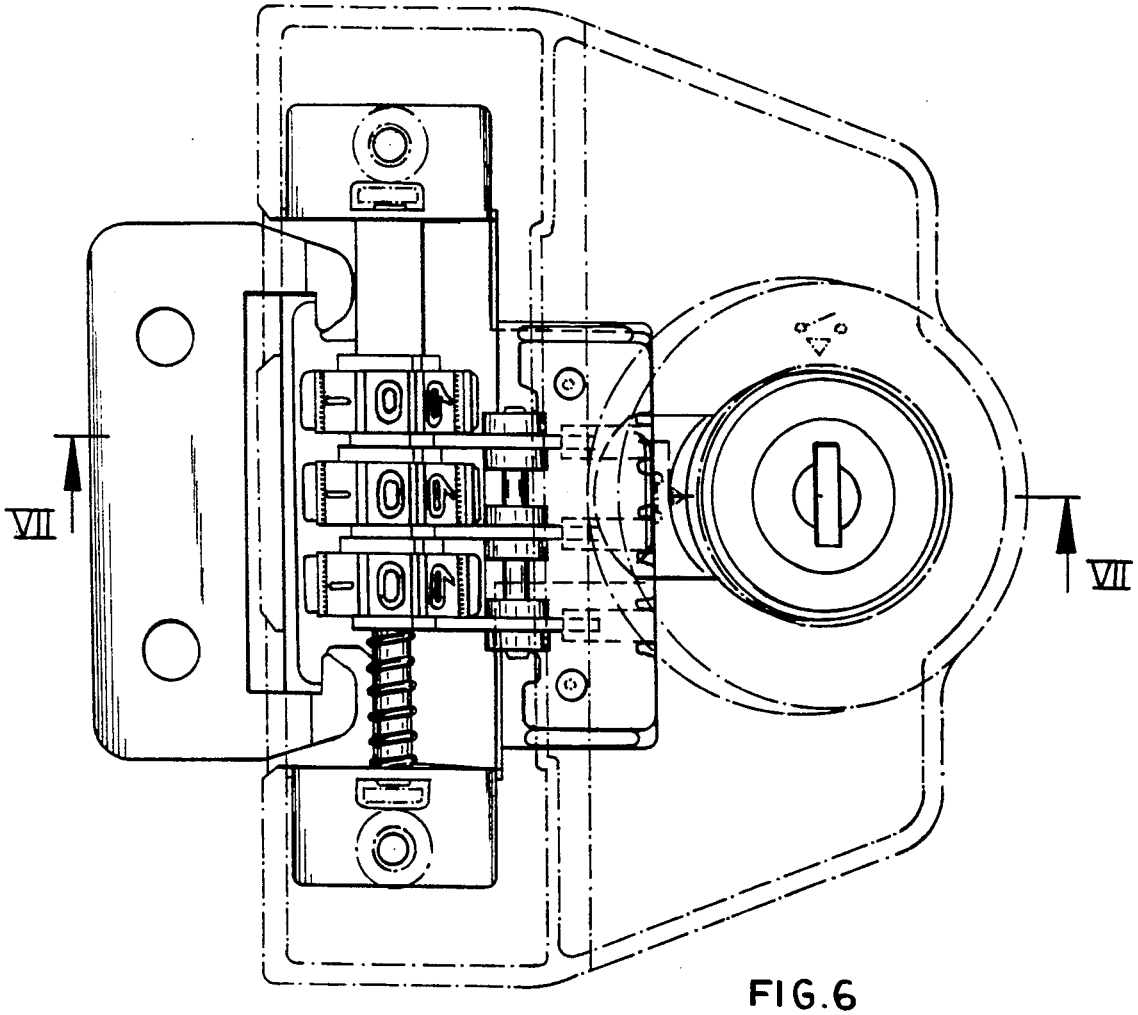
FIG.6

KEY AND COMBINATION LOCK FOR LUGGAGE

FIELD OF THE INVENTION

The present invention relates to a luggage lock. More particularly this invention concerns such a lock of the combination type.

BACKGROUND OF THE INVENTION

A standard luggage latch has a housing mounted on the piece of luggage and a latch body or slide displaceable in the housing between a latched and unlatched position and engageable only in the latched position with a latch component on the luggage lid to retain the latch component. A combination lock comprises a plurality of wheels that each have a peripheral row of numbers that can be viewed through a window of the latch housing. Respective rings rotationally coupled to the wheels have flats that are engaged by a keeper so that only when all of the flats are axially aligned can the latch component be disengaged from the keeper.

When such a latch is provided on a high-security transfer case such as is used by a courier to move documents or financial instruments between offices, security dictates that the combination only be known by the parties who are sending and receiving the package. In addition it is normally considered good practice to change the combination regularly in order to avoid that unauthorized persons gain access to the contents of the security case.

For the main office, keeping track of the numerous combinations of the various transfer cases is a significant nuisance, especially when they are changed every time there is a critical personnel change at a branch office. This is compounded by the fact that it is normally essential to know the current combination in order to be able to reset it.

OBJECTS OF THE INVENTION

It is therefore an object of the present invention to provide an improved high-security luggage latch.

Another object is the provision of such an improved high-security luggage latch which overcomes the above-given disadvantages, that is which on the one hand avoids the problems of keeping track of numerous combinations and on the other hand makes it possible to reset the combination even if the current combination is unknown to the person doing the reset.

SUMMARY OF THE INVENTION

A luggage latch for securing together two relatively movable parts according to the invention has a latch housing on one of the parts, a latch component on the other of the parts engageable in the latch housing, and a keeper displaceable in the latch housing between a retaining position engaging and retaining the latch component and a freeing position out of engagement with the latch component and permitting same to be withdrawn from the housing. In accordance with this invention a combination lock on the housing has combination-lock elements operatively engageable with the keeper and movable between a locked position and an unlocked position respectively corresponding to the retaining and freeing positions of the keeper. In addition a key lock on the housing has a key-lock element operatively engageable with the keeper and movable between a locked position and a unlocked position respectively corresponding to the retaining and freeing position of the keeper. Either of the locks is capable of moving the keeper from the retaining to the freeing position regardless of the position of the other lock.

More particularly according to the invention the retaining position of the keeper is a central position and it can move in opposite directions into two end freeing positions. The combination lock allows the keeper to move into one freeing position when it is unlocked and the key lock move it into the other freeing position when it is unlocked.

Thus with the system of this invention at the main office a key can be used to unlock the security cases. The person at this location does not have to keep track of or even know the combinations to the individual locks. Maintaining the key secure at the main office is fairly simple, even when it is a master key that opens all the cases, and the branch offices can select and change combinations at will.

According to further features of this invention a spring is braced between the housing and the keeper and urges the keeper into the one freeing position. Thus as soon as the combination is selected the lock will spring open.

The key-lock element of this invention is an arm engageable with the keeper to move it against the force of the spring. The combination-lock elements are the standard combination of a wheel and a ring rotationally coupled to it and formed with a flat.

In accordance with a further feature of this invention the lock is provided with a decoder connected between the key lock and the combination lock for retaining the combination-lock elements in the unlocked positions when the key lock is in the unlocked position. In this case the lock elements are rotatable wheels each normally rotationally coupled to respective rings and each formed with a radially open decoding notch. The decoder includes respective pawls carried on the housing and engageable only in the unlocked position of the key lock in the notches. Respective springs urge the pawls out of engagement with the respective rings. This system therefore means that the person at the main office with the key can unlock the case and then spin the combination wheels until each of then stops and is held at the position corresponding to the set combination. The combination is then readable, and can be reset if necessary, as it is invariably necessary to know the current combination in order to reset it.

BRIEF DESCRIPTION OF THE DRAWING

The above and other objects, features, and advantages will become more readily apparent from the following, reference being made to the accompanying drawing in which:

FIG. 6 is a view like FIG. 5 of another lock according to the invention;

FIG. 7 is a section taken along line VII—VII of FIG. 6;

SPECIFIC DESCRIPTION

Figure 1:
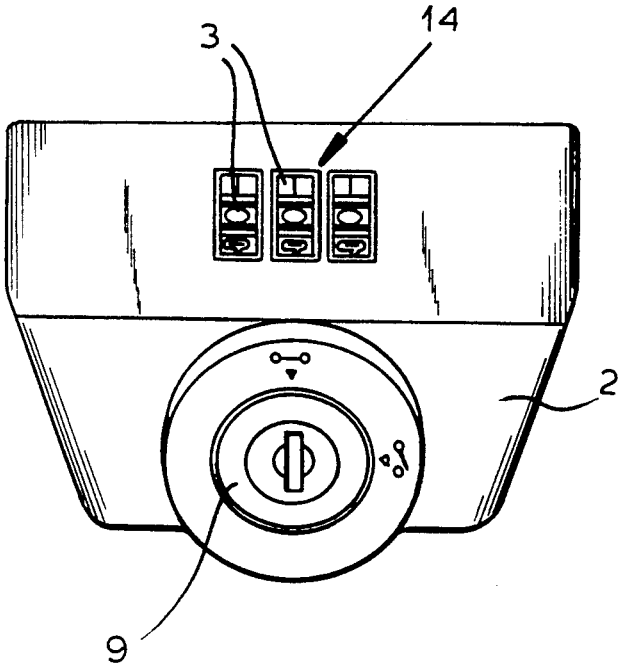
FIG. 1 is a front view of the lock according to the invention.
Figure 2:
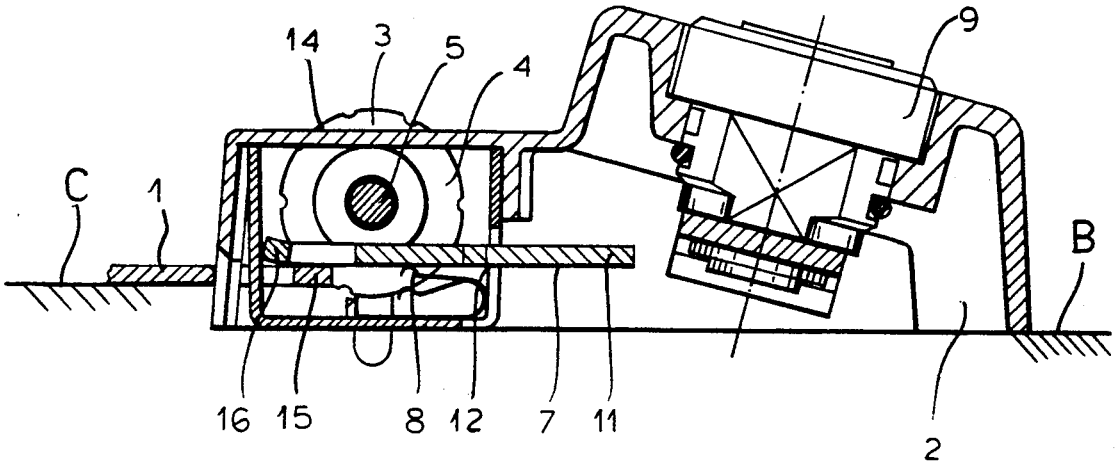
FIG. 2 is a cross section through the lock of FIG. 1, in the combination-unlocked position.
Figure 3:
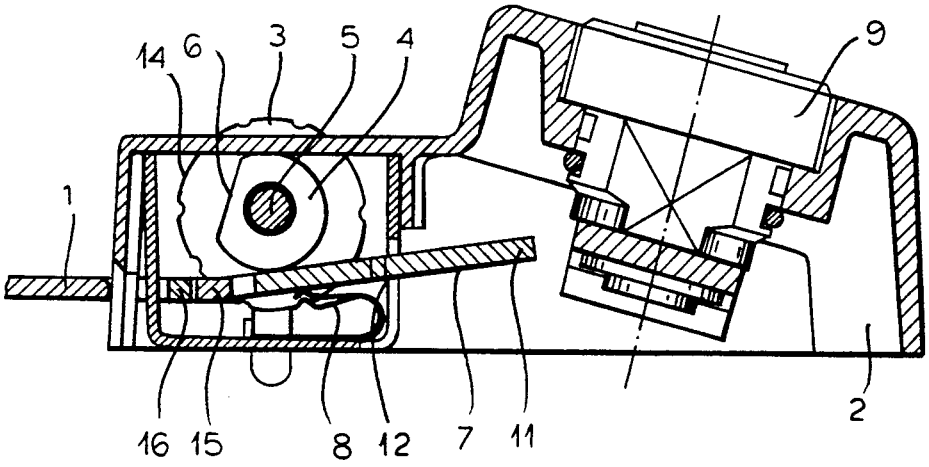
FIG. 3 is a view like FIG. 2 but in the locked position.

As seen in FIGS. 1 through 5 a luggage lock according to this invention comprises a latch component 1 normally mounted on the cover C of the piece of luggage and formed with a pair of opposed hooks 15 and a latch housing 2 normally mounted on the body B of the piece of luggage and containing a keeper 7 pivotal about an axis 12 and formed with oppositely directed hooks 16 that can engage with the hooks 15. The housing 2 carries a standard cylinder-type key lock 9 and a combination lock 14. An encoding button 13 on the bottom of the housing 2 can be actuated to reset the combination lock 14 in the manner generally described in commonly owned U.S. Pat. No. 4,934,162.

The combination lock 14 has a plurality of wheels 3 rotatable on an axle 5 and normally coupled rotationally to respective rings 4 each formed with one secantally extending flat 6. A spring 8 has arms engaged in angularly equispaced notches formed in the wheels 3 which also carry numbers and further has an arm that urges the keeper 7 away from engagement with the hooks 15. The keeper 7 is continuously urged by the spring 8 into radial engagement with the rings 4 and only when all of the flats are axially aligned and the keeper 7 is resting against them can the keeper 7 move up out of the locked position of FIG. 3 into the unlocked position of FIG. 2.

Figure 4:
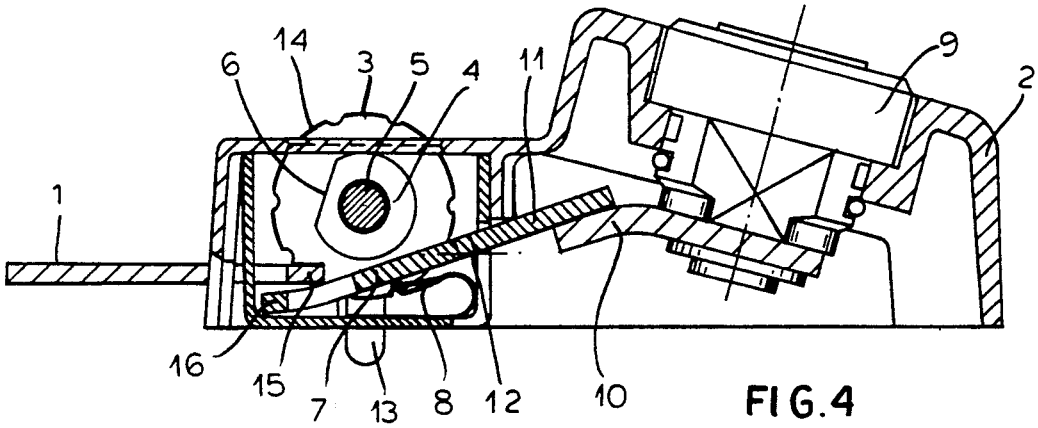
FIG. 4 is a view like FIG. 2 but in the key-unlocked position.
Figure 5:
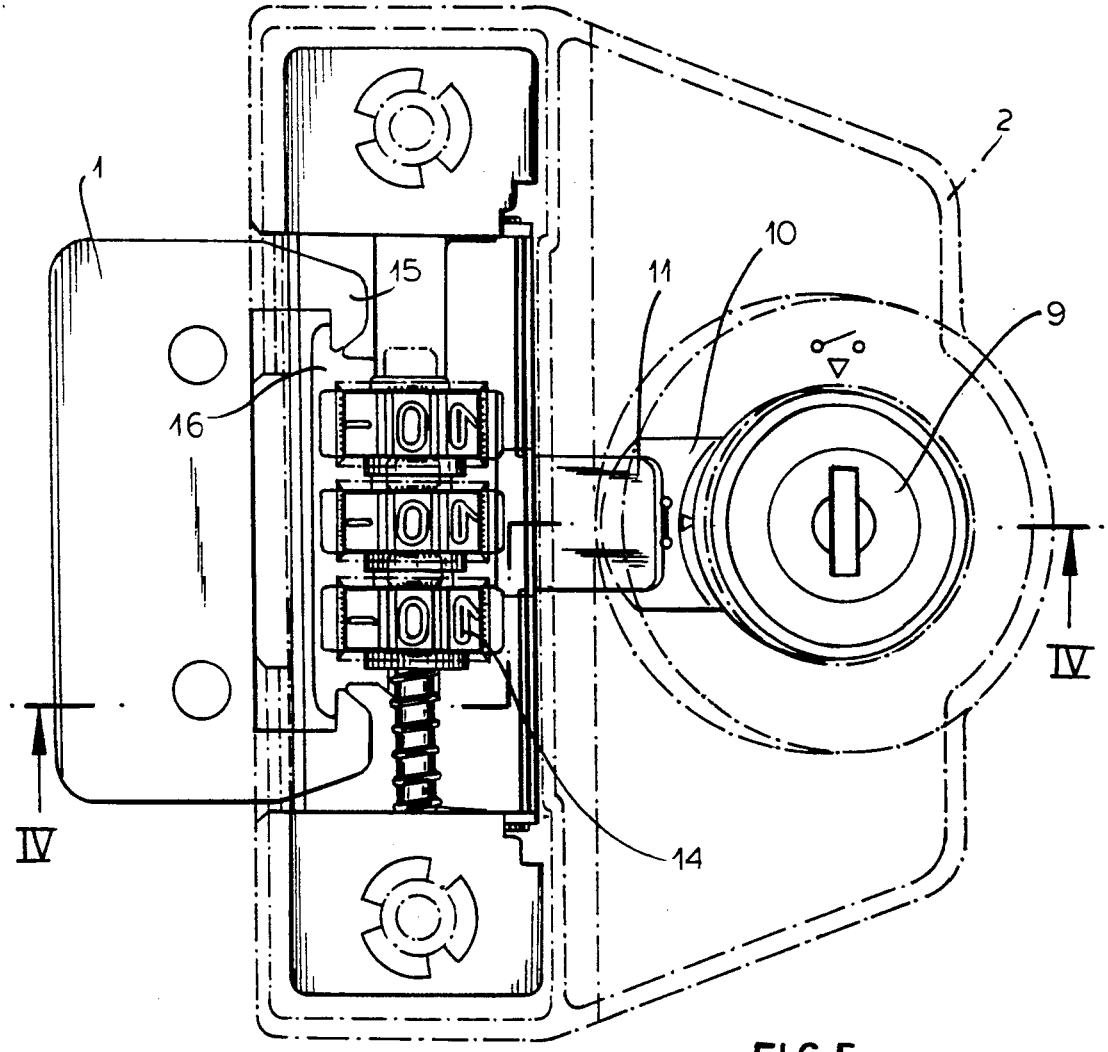
FIG. 5 is a top view of the structure of FIG. 4, line IV—IV of FIG. 5 indicating the section plane for FIG. 4.

The key lock 9 has an arm 10 that can engage an extension 11 of the keeper 7 to pivot it down against the force of the spring 8 out of engagement with the latch component 1 as shown in FIG. 4. Thus when the lock is unlatched by the combination lock 14 the keeper 7 is pivoted up from the retaining position into one freeing position, and when it is unlatched by the key lock 9 it is pivoted down into another freeing position. The two locks 9 and 14 therefore are completely independent of each other; operation of the one is in no way dependent on the position of the other.

In FIGS. 6 through 9 structure identical to that of FIGS. 1 through 5 bears the same reference numerals. This lock is provided with a system which allows a person with a key for the key lock 9 to determine what the combination of the lock 14 is.

Figure 9:
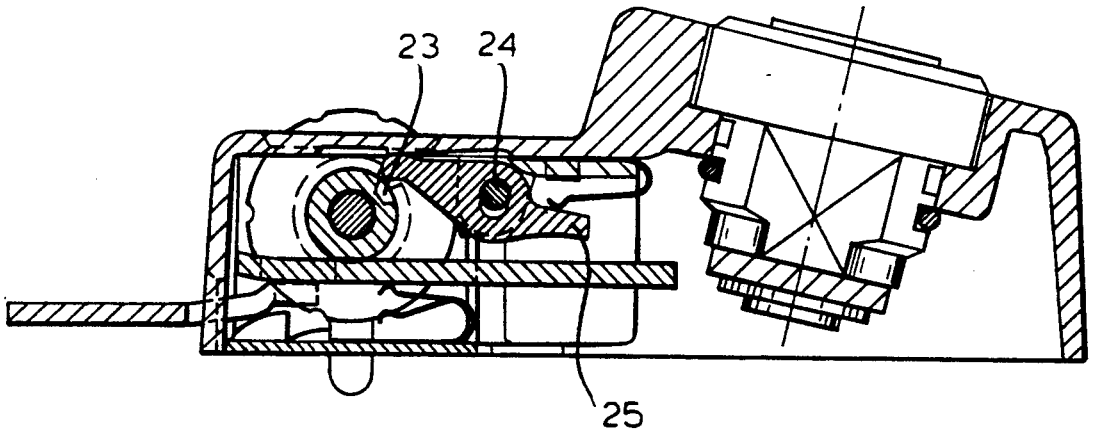
FIG. 9 is a view like FIG. 7 but in the combination-unlocked position.
Figure 8:
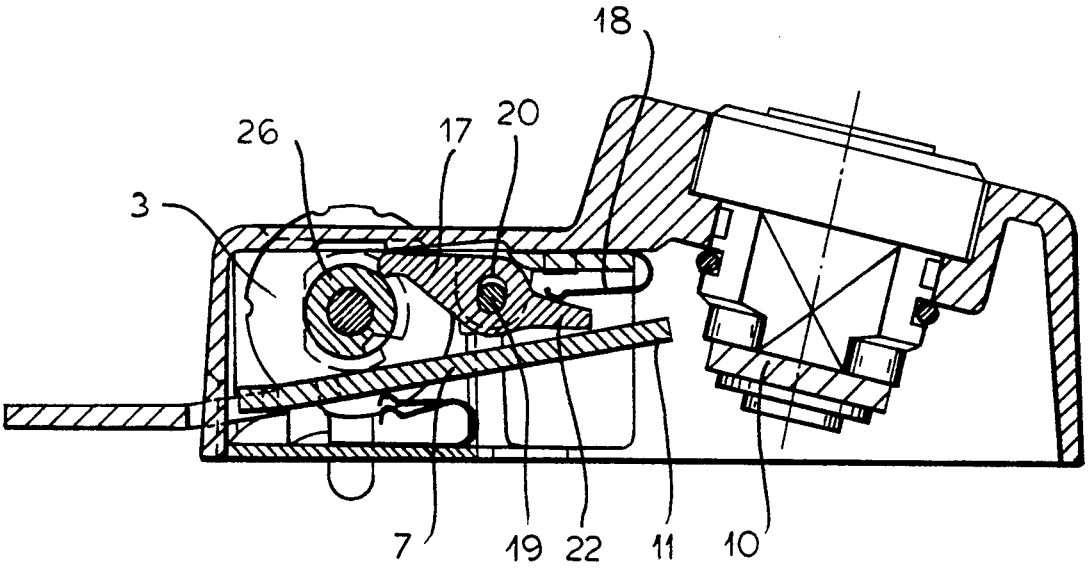
FIG. 8 is a view like FIG. 7 but with the lock in the locked position.

To this end the wheel rings 3 carry rings 26 that are each formed with a radially outwardly open notch 23 into which an end 21 of a decoding lever or pawl 17 can engage. These notches 23 are all at the same angular spacing from the respective flat 6 so that the end 21 can engage in each of them only when they are axially aligned in the unlocked position. The pawls 17 are each formed centrally with a pivot slot 20 through which engages a pivot pin 24 and all have arms 25 opposite their ends 21 that are urged downward by respective spring arms 18. Thus under normal conditions the spring arms 18 pivot the pawls 17 to keep them completely out of engagement with the rings 23 as shown in FIGS. 8 and 9, even when the ends 21 are aligned with the notches 23.

When, however, the key lock 9 is operated to tip up the keeper 7 as shown in FIG. 6, the rear ends 25 of the pawls 17 will be pushed up by the keeper 7, switching the pawls from first-class to third-class action so that the springs 18 are now urging the front ends 21 downward against the rings 26. If a notch 23 is aligned with the end 21, same will drop into it and retain the respective wheel 3 against further rotation. If not, the pawl 17 will ride on the surface of the ring 26 with the axle 18 in the bottom of the slot hole 20.

Thus in the position with the latch opened by the key switch, the user need merely rotate the wheels 3 until the respective pawls 17 drop into the notches 23, thereby substantially inhibiting further rotation of the respective wheels 3. This is important because it is necessary that the combination lock 14 be in the unlocked position when its combination is reset. With the system of FIGS. 6 through 9, therefore, a user who does not know the combination but who has a key can determine the combination and, if desired, then operate the encoding button 13 to change it.

We claim:

1. A luggage latch for securing together two relatively movable parts, the latch comprising:
   - a latch housing on one of the parts;
   - a latch component on the other of the parts engageable in the latch housing;
   - a keeper displaceable in the latch housing between a central retaining position engaging and retaining the latch component and a pair of end freeing positions out of engagement with the latch component and permitting same to be withdrawn from the housing;
   - a combination lock on the housing having combination-lock elements operatively engageable with the keeper and movable between a locked position and an unlocked position respectively corresponding to the retaining and one of the freeing positions of the keeper; and
   - a key lock on the housing having a key-lock element operatively engageable with the keeper and movable between a locked position and an unlocked position respectively corresponding to the retaining and the other freeing position of the keeper.

2. The latch defined in claim 1, further comprising
   - a spring braced between the housing and the keeper and urging the keeper into the one freeing position.

3. The latch defined in claim 2 wherein the key-lock element is an arm engageable with the keeper to move it against the force of the spring.

4. The latch defined in claim 1, further comprising:
   - decoding means connected between the key lock and the combination lock for retaining the combination-lock elements in the unlocked position when the key lock is in the unlocked position.

5. The latch defined in claim 4 wherein the lock elements are rotatable wheels each normally rotationally coupled to respective rings each formed with a radially open decoding notch, the decoding means including respective pawls carried on the housing and engageable only in the unlocked position of the key lock in the notches.

6. The latch defined in claim 4 wherein the decoding means further comprises respective springs urging the pawls out of engagement with the respective rings.

7. The latch defined in claim 1 wherein the keeper is pivotal between its central retaining position and its end freeing positions.

* * * * *